US006213900B1

(12) United States Patent
Steyn et al.

(10) Patent No.: US 6,213,900 B1
(45) Date of Patent: Apr. 10, 2001

(54) CONCAVE REBOUNDING SURFACE FOR PLAYING A BALL GAME

(75) Inventors: Martin Steyn, Richterswil; Renato P. Rüede, Mettmenstetten, both of (CH)

(73) Assignee: Skyball Int. Ltd., Vaduz (LI)

( * ) Notice: Subject to any disclaimer, the term of this patent is extended or adjusted under 35 U.S.C. 154(b) by 0 days.

(21) Appl. No.: 09/317,985

(22) Filed: May 25, 1999

(30) Foreign Application Priority Data

May 25, 1998 (CH) ..... 1136/98

(51) Int. Cl.[7] ..... A63B 69/00
(52) U.S. Cl. ..... 473/434; 473/415; 473/426
(58) Field of Search ..... 473/434, 435, 473/444, FOR 104; 273/400

(56) References Cited

U.S. PATENT DOCUMENTS

| | | | | |
|---|---|---|---|---|
| 3,697,068 | * | 10/1972 | McDougall | 473/434 |
| 4,373,720 | * | 2/1983 | Lombardi et al. | 473/434 |
| 5,484,147 | * | 1/1996 | Fagan | 273/411 |
| 5,795,252 | * | 8/1998 | Crucet | 473/434 |

FOREIGN PATENT DOCUMENTS

| | | | | |
|---|---|---|---|---|
| 2308082 | * | 8/1974 | (DE) | 473/104 |

* cited by examiner

*Primary Examiner*—Jeanette Chapman
*Assistant Examiner*—Mitra Aryanpour
(74) *Attorney, Agent, or Firm*—Browdy and Neimark

(57) ABSTRACT

A concave rebounding surface is provided which permits a ball game similar to squash to be played outdoors.

17 Claims, 4 Drawing Sheets

CONCAVE REBOUNDING SURFACE FOR PLAYING A BALL GAME

FIELD OF THE INVENTION

The present invention relates to equipment for a ball game.

DESCRIPTION OF RELATED PRIOR ART

Squash is a ball game normally confined to the indoors. The nature of the game requires a hard floor (e.g., parquet), and at least three surrounding walls, each at right angles to the ground and to the adjacent wall. The game proceeds as one of two players uses a racket to hit a ball against the middle or front wall of the playing room. The ball is allowed to rebound from the wall, then hit and bounce off the ground. At this point, a second player intercepts the ball, using his or her racket to hit the ball toward the middle or front wall.

OBJECT OF THE INVENTION

The object of the present invention is to provide equipment which makes it possible for a ball game similar to squash to be played outdoors.

BRIEF DESCRIPTION OF THE DRAWINGS

The following embodiments of the present invention are explained in more detail with reference to the enclosed drawings.

DETAILED DESCRIPTION OF THE PREFERRED EMBODIMENTS OF THE INVENTION

Figure 1:
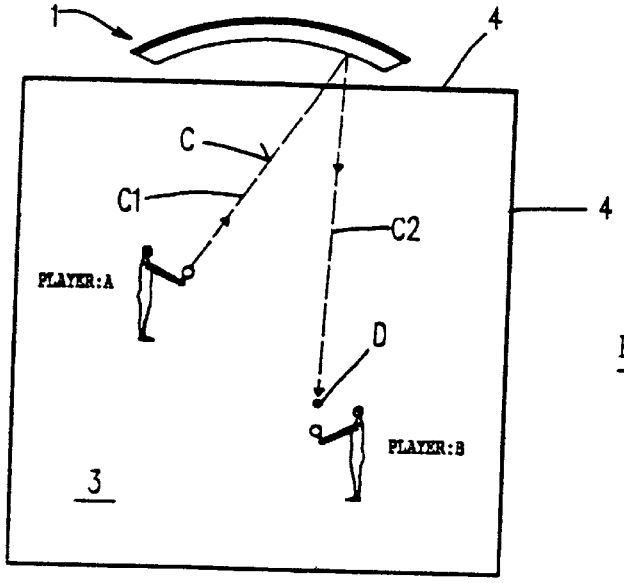
FIG. 1 shows in a plan view a field for a ball game comprising an arrangement off which a ball may rebound.
Figure 4:
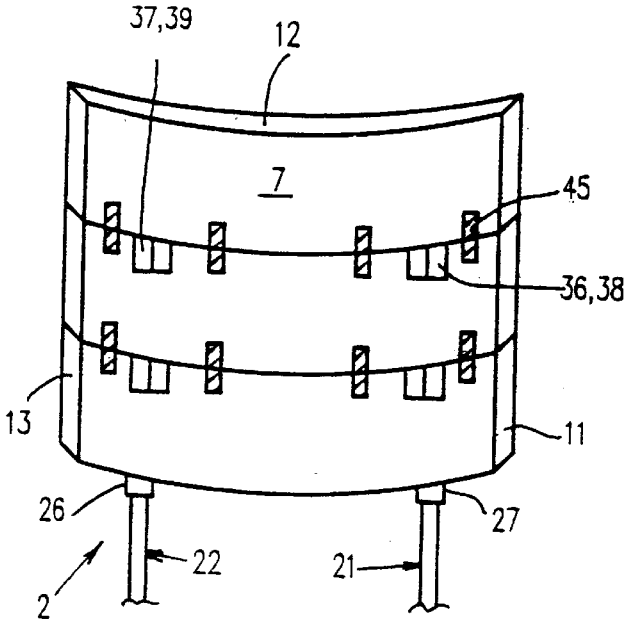
FIG. 4 shows in a back view the arrangement of FIG. 1.

Referring to FIG. 1, the present invention comprises a rebounding surface (1, FIG. 1) attached to a support stand (2). The device is placed outside a playing area (3), either indoors or out. Optimally, the midpoint of the stand (2) aligns with that of one edge of the playing area (3). Players (A,B) then take turns hitting a ball (D) against the rebounding surface (1). The ball (D) follows the trajectory (C), whereby the ball (D) rebounds off surface (1) but remains within the area of the playing field (3).

Referring now to FIGS. 2–8, the rebounding surface (1) has a main body (5) in the shape of a segment of the interior surface of a cylinder. The axis (not shown) of the main body (5) runs diagonally to a horizontal plane. This main body has a rear surface (7) and a concave front surface (6), wherein these surfaces extend parallel to each other. The main body (5) is inclined such that its upper edge is more distant from the playing field (3) than is its lower edge. The angle of incline ($\alpha$) is preferably between 55 and 85 degrees, 75 degrees being optimal.

The preferred angle of incline ($\alpha$) of the front surface (6) causes the ball (D) to follow a trajectory in the shape of an upward convex bow. The location at which the ball hits the floor or ground of the playing field (i.e., the distance from the front of the rebound surface (6)) depends oil the magnitude of the angle of incline. This creates interrelation between the magnitude of the angle of incline and the dimensions of the playing field (3), particularly as to the depth or length thereof.

The rebound surface's convex front (6) causes the ball (D) to rebound within the confines of the playing field (3), even if the ball (D) fails to impact the middle region (M) of the front surface (6). Hence, there is also an interrelation between the curvature of the front surface (6) and the dimensions of the playing field (3), particularly the width of the playing field. The radius (R) of the curvature of the front surface (6) can, for example, amount to a maximum of 1.45 m for a playing field spanning a width of 4 m. Under such circumstances, the rebounding surface (1) may have a width (T) of 1.25 m and side edges (H) of 1 m in length.

In a first embodiment of the present invention, the rebounding surface (1) has a thick walled main body (5), optionally of uniform thickness. The rear surface (7) or the main body runs substantially parallel to the front surface (6).

In the rim areas of the main body (5), four thick or wide edge surfaces (11,12,13,14) extend between the front surface (6) and the rear surface (7). The main body (5) is positioned in such a way that two of the wide edge surfaces (11,13) extend substantially in a vertical direction and the two remaining edges (12,14) extend substantially horizontally. The horizontal edge surfaces (12,14) are arch shaped like the main body and are oriented substantially normal to surface line M. Furthermore, the inclination of the main body (5) causes the distance between the upper arched edge surface (12) and the playing field (3) and players (A,B) to be greater than that between said field and players and the lower arched edge surface (14). Edge surfaces 11 and 13 are essentially straight.

Figure 3:
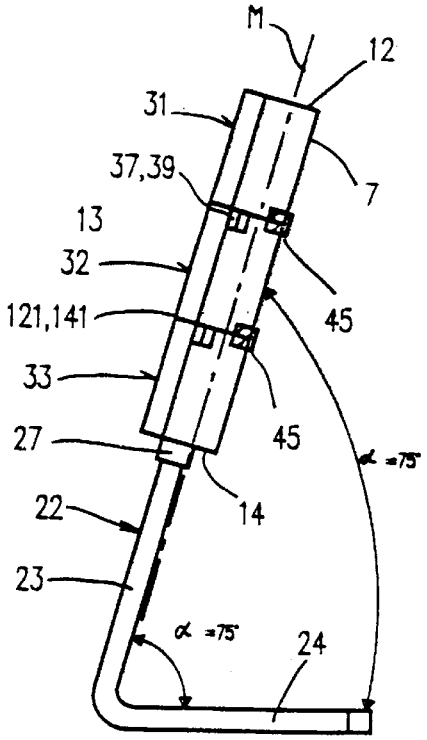
FIG. 3 shows in a side view the arrangement of FIG. 1.
Figure 2:
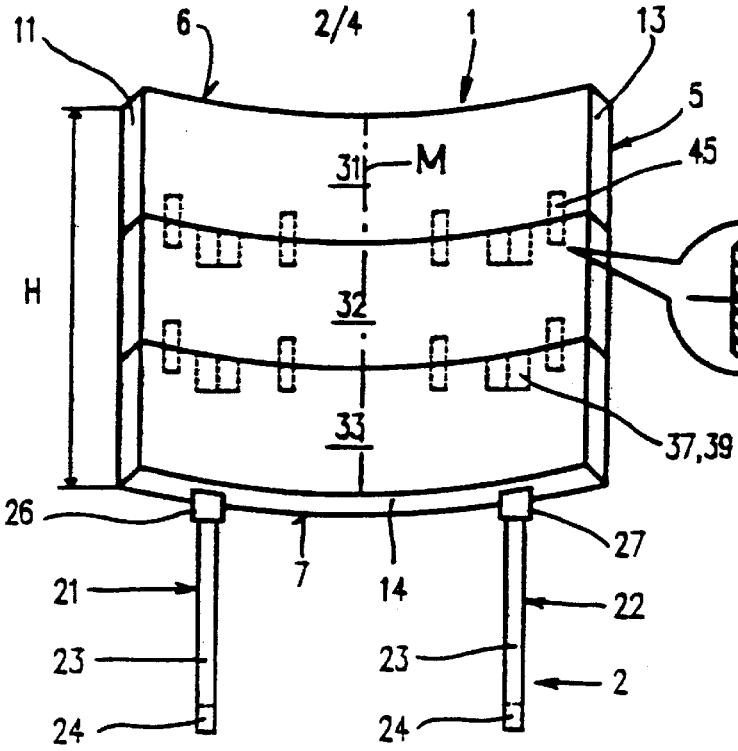
FIG. 2 shows in a front view the arrangement of FIG. 1.
Figure 7:
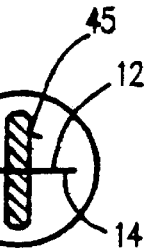
FIG. 7 shows an enlarged detail of FIG. 2.
Figure 5:
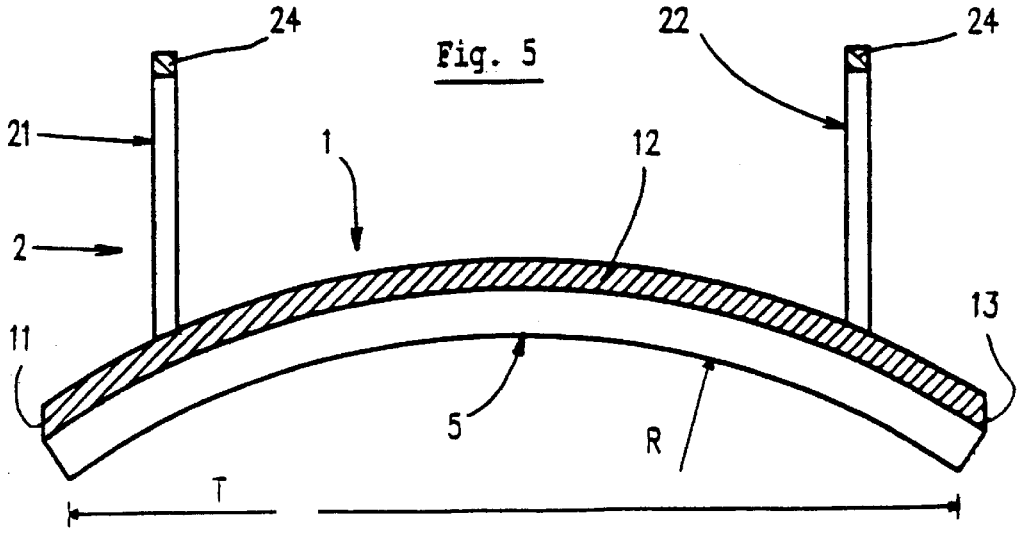
FIG. 5 shows in a top view the arrangement of FIG. 1.

The stand (2) comprises two L-shaped supports (21,22). Each support (21,22) consists of a single piece of an elongated material bent to form an angle. This elongated material, which may be of steel, aluminum, or the like, can have a rectangular or circular cross section. Each support (21,22) possesses corresponding legs (23,24) (FIG. 3). The magnitude of angle ($\beta$), extending between legs 23 and 24, is the same as that of the angle of incline ($\alpha$) of the main body (5). When in use, the rebounding surface (1) is engaged with the upper legs (23) of the supports (21,22).

Sets of support pairs (21,22) are possible, whereby the angle ($\beta$) between support legs (23,24) have different magnitudes, preferably (as with the magnitude of angle $\alpha$) between 55 and 85 degrees. In such instances, the angle of incline of the main body (5) may be adjusted according to which set of support legs (23,24) said main body is attached.

In the present invention, the rebounding surface (1) is provided with two spaced sleeves (26,27) positioned near the lower edge surface (14) of the main body (5). The longitudinal axis of each sleeve (26,27) is essentially normal to the lower edge surface (14) of the main body (5) and is substantially parallel to surface line M of the main body (5). The bottom of the spaced sleeves (26,27) may rest on the lower edge surface (14) of the main body, or, alternately, sleeves 26 and 27 may be partially or completely sunk therein. Sleeves 26 and 27 may also be attached to the rear surface (7) or the main body (5). The free end portion of the upward directed support leg (23) of supports 21 and 22 fits into sleeves 26 and 27, respectively, and, if necessary, is also secured thereto. The resulting setup is best illustrated in FIG. 3.

Figure 6:
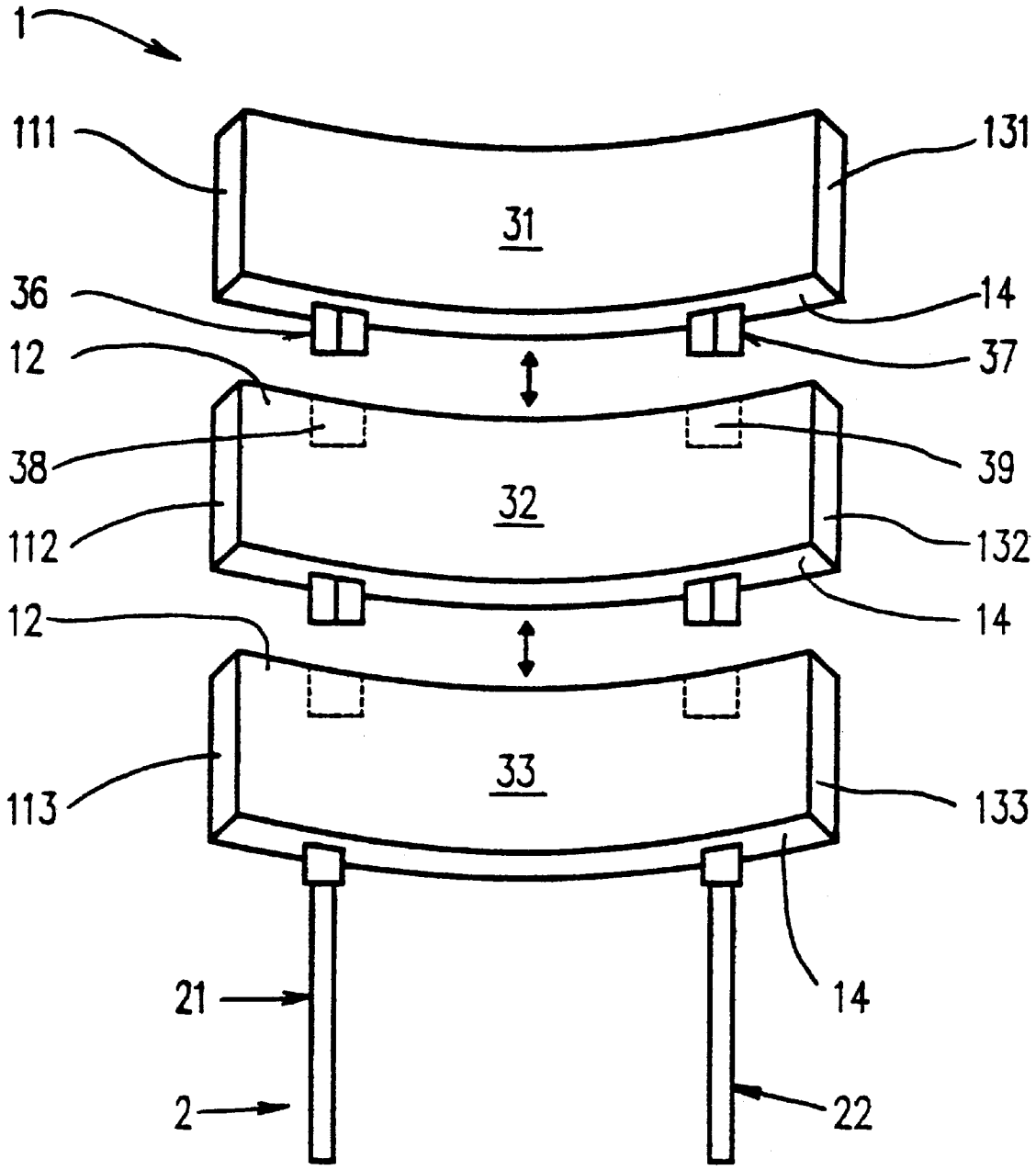
FIG. 6 shows an exploded representation of the arrangement of FIG. 1.

In a further embodiment of the present invention, the main body (5) of the rebounding surface (1) may be composed of more than one individual sections or panels (e.g., 31,32,33), as seen in FIG. 6. Each panel (31,32,33) has the form of a segment of the surface of a cylinder, such that each has a front surface (6) and upper (12) and lower (14) arched edge surfaces. The uppermost panel (31) is attached to the next lower panel (32) in such a way that the lower arched edge (14) of the uppermost panel rests atop the upper arched edge surface (12) of the next lower panel (32). In this manner, the superposition of several panels atop each other forms a uniform, curved surface (6) of a rebounding surface (1).

By way of example, if the vertical edge surfaces (11,13) of the main body (5) are approximately 1 m long, and said main body is comprised of three panels (31,32,33), then the vertical edge surfaces (111,112,113,131,132,133) of said three panels (31,32,33) are each approximately 33.3 cm in length.

The use of multiple panels to build the main body (5) of the rebounding surface (1) permits the user to adjust the surface area of the device according to his or her skill level. A beginner will most likely want to use all panels (31,32,33) to maintain a larger playing surface, whereas a more experienced player can increase the difficulty of the game by removing one or more panels.

Figure 8:
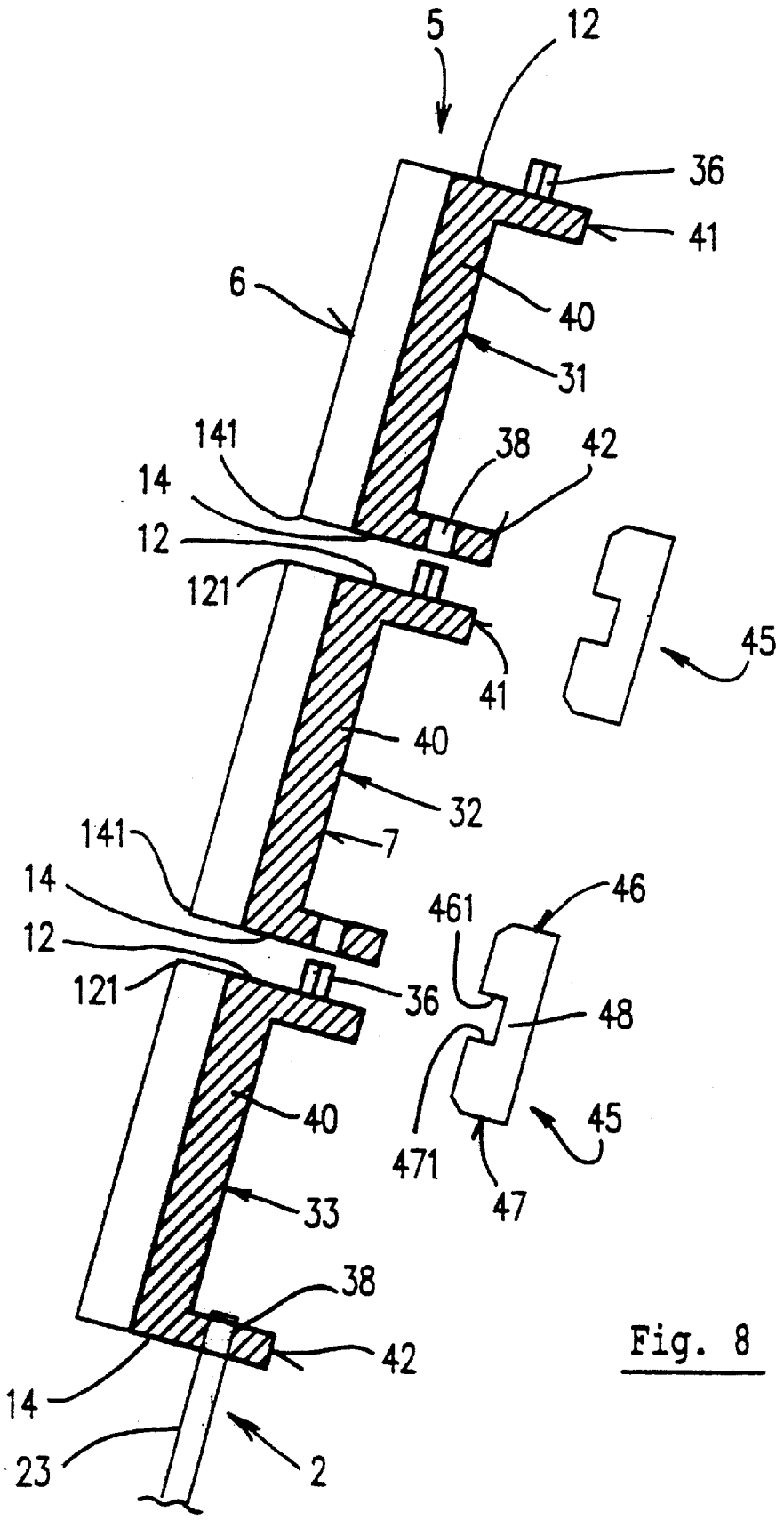
FIG. 8 shows an exploded representation of a vertical cut through FIG. 3.

For optimal results, it is necessary that the front surface (6) of the rebounding device (1) be as smooth as possible. It is therefore essential that the edges (121, 141) of the horizontal rim surfaces (12,14) of neighboring panels 31,32, and 33 remain in the plane of the front surface (6) throughout the lifetime of the device. To this end, means for mounting and securing the neighboring panels (31,32,33) in exact alignment are foreseen. Specifically, there are provided pins or pegs (36,37) and openings (38,39) for insertion of said pins (36,37) therein. As seen in FIGS. 6 and 8, these pins (36,37) protrude from the upper arched edge surface (12) of each panel (31,32,33). The openings (38,39) into which the pins (36,37) fit are situated on the lower arched edge surface (14) each panel (31,32,33). The form and dimensions of the pins (36,37) and the holes into which they fit (38,39) should correspond as closely as possible, so as avoid any movement, shifting, or misalignment of the panels (31,32,33) due to loose connections therebetween. In the present example, pins 36 and 37, as well as their respective holes (38,39), all have rectangular cross sections. It should be understood, however, from the above description, that the cross-section of the pins and holes may have other forms, e.g., circular.

To minimize manufacturing costs, it is preferable that all panels (31,32,33) are of the same shape. Hence, the fitting pins (36,37) project upwards from the upper arched edge surface (12) of the main body panels (31,32,33), and the receiving holes (38,39) for said pins are positioned on the lower arched edge surface (14) of the main body panels (31,32,33).

The receiving holes (38,39) of the lowermost panel (33) cannot engage with any fitting pins (36,37). However, if, as is contemplated in the present invention, the cross sections of the main body's support legs (21,22) are identical to that of the receiving holes (38,39), the upper portion (23) of said support legs (21,22) may be inserted into the receiving holes (38,39) of the lowermost panel (33). In such a situation, separate means can be omitted for receiving the upper legs (23) of main body supports 21 and 22. The fitting pins (36,37) of the uppermost panel (31) may be used for other purposes.

The main body (5) of the rebounding surface (1) must possess sufficient mass to permit the ball (D) to rebound back to the players (A,B) with adequate force. It is essential, therefore, that the main body (5) and the panels of which it is comprised (31,32,33) constitute a relatively thick material. Alternatively, the front surface (6) of the main body (5) and its panels (31,32,33) may consist of a thin plate (40) from which reinforcing ribs project to impart the necessary mass to the rebounding surface. According to the present invention, one reinforcing rib (41 or 42) attaches to one arched edge surface (12 or 14).

If the main body is comprised of panels (31,32,33), as in FIG. 8, then each arched edge surface (12,14) is reinforced with one rib (41,42). More specifically, the ribs (41,42) are oriented such that they extend essentially horizontally, the outer lateral surface of each rib (41,42) lying flush with its corresponding arched edge surface (12,14). If necessary, additional horizontal ribs may be positioned between and parallel to ribs 41 and 42.

Additionally, vertical ribs may be utilized, said ribs protruding from the rear surface of the thin surface plate (40). These ribs may be positioned along the vertical edge surfaces (11,13 or 111,112,113 and 131,132,133) or in the middle region of the thin surface plate (40).

The main body (5) or the panels (31,32,33) of which it may be comprised are preferably made of plastic, for example, polypropylene.

If the main body (5) of the rebounding surface (1) is comprised of superimposed panels (31,32,33), it is preferable to use means in addition to the fitting pins (26,27) to hold said panels (31,32,33) together. In the present invention, the use of U-shaped clamps (45) is contemplated. Each clamp (45) has parallel legs (46,47), the end portion of one leg connected by a bridge (48) with the end portion of the other leg. Furthermore, the distance between the inside surfaces (461,471) of the clamp legs is such that the horizontal edge ribs (41,42) may be positioned between the inside surfaces (461,471) of the clamp (45).

Although the foregoing disclosure relates to a rebound surface for squash players, because the inclination of the rebounding surface (6) returns the ball (D) to the players along an arcuate path, the device (1) is appropriate for use on soft ground, such as a beach or lawn. The concave surface of the main body (5) prevents the ball (D) from leaving the playing field (3), even when the ball (D) is not hit into the middle region of the main body (5).

What is claimed is:

1. Equipment for a ball game having a rebounding surface (1) with an inclined main body (5), wherein the main body (5) is comprised of panels (31,32,33), each of said panels (31,32,33) having a form of a segment of a surface of a cylinder and each of said panels being engaged to each other along arched edge surfaces (12,14) so that the panels (31, 32,33) rest one on top of the other, with means provided for securely holding said panels (31,32,33) such that their vertical edges (11, 13 or 111,112,113,131,132,133) are in precise alignment with one another, and wherein each of the panels (31,32,33) have a substantially rectangular front plate (40); and the plate (40) is thin walled and has reinforcing ribs (41,42) that protrude from the arched edge surfaces (12,14) of the panels (31,32,33) in a manner such that the outwardly directed lateral surface of the ribs (41,42) are flush with their respective arched edge surfaces (12,14).

2. The equipment according to claim 1 wherein the axis of the segment of the surface of a cylinder formed by the panels (31,32,33) of the main body (5) is inclined diagonally with respect to a horizontal plane and forms an acute angle, ($\alpha$), with said horizontal plane.

3. The equipment according to claim 1, wherein the main body (5) is connected to a supporting rack (2).

4. The equipment according to claim 3 wherein the supporting rack is comprised of two essentially L-shaped supports (21,22), each support having an upper (23) and lower (24) leg, the free end of said upper leg (23) engaging with the main body (5) and being inclined at the same angle of inclination as said main body (5).

5. The equipment according to claim 1, wherein said means for holding panels (31,32,33) in stacked relation to one another comprises protruding pins (36,37) designed to fit securely into corresponding receiving holes (38,39).

6. The equipment according to claim 5, wherein said pins (36,37) and said receiving holes are positioned in the arched edge surfaces (12,14) of the panels (31,32,33).

7. The equipment according to claim 5, wherein the fitting pins (36,37) project from one of the arched edge surfaces (12,14) of the panels (31,32,33) and the corresponding receiving holes (38,39) are located in the arched edge surface (12,14) of a neighboring panel (31,32,33).

8. The equipment according to claim 1 wherein U shaped clamps (45) provide additional means for securing the panels (31,32,33) in stacked alignment with one another.

9. The equipment according to claim 1 wherein the fitting pins (36,37) project from the lateral surface of one of the reinforcing ribs (41,42), and the corresponding receiving holes (38,39) for said pins (36,37) are positioned in the lateral surface of one of the ribs (41,42) of an adjacently positioned panel (31,32,33).

10. The equipment according to claim 9 wherein the fitting pins (36,37) protrude from the upper arched horizontal reinforcing rib (41) of a panel (31,32,33) and that the corresponding receiving holes (38,39) are placed in the lower arched horizontal reinforcing rib (42) of a neighboring panel (31,32,33).

11. The equipment according to claim 1 wherein the reinforcing ribs (41,42) of each panel (31,32,33) are placed between legs (46,47) of a U-shaped clamp (45).

12. The equipment according to claim 1 wherein the lower arched edge surface (14) of the main body panels (31,32,33) or the lateral surface of the lower horizontal rib (42) is provided with sleeves (26,27) for receiving the free end portion of an upwardly directed leg (23) of supports (21,22).

13. The equipment according to claim 12 wherein the sleeves (26,27) for receiving the upwardly directed leg (23) of supports (21,22) include means for securing the leg (23) to said sleeves (26,27).

14. The equipment according to claim 1, wherein additional horizontal reinforcing ribs are positioned between and parallel to the edge horizontal ribs (41,42).

15. The equipment according to claim 1, wherein vertical reinforcing ribs are also provided.

16. The equipment according to claim 15, wherein the vertical reinforcing ribs are positioned so as to protrude from the back of the vertical edges (111,112,113,131,132,133) of the main body panels (31,32,33).

17. The equipment according to claim 16, wherein additional vertical reinforcing ribs are placed between the vertical edges (111,112,113,131,132,133) of the main body panels (31,32,33).

* * * * *